US008457534B2

(12) United States Patent
Sakamaki et al.

(10) Patent No.: US 8,457,534 B2
(45) Date of Patent: Jun. 4, 2013

(54) DEVELOPING APPARATUS

(75) Inventors: Tomoyuki Sakamaki, Toride (JP); Yuji Bessho, Abiko (JP); Masanori Akita, Toride (JP); Toshiyuki Yamada, Kashiwa (JP); Atsushi Matsumoto, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 228 days.

(21) Appl. No.: 13/004,466

(22) Filed: Jan. 11, 2011

(65) Prior Publication Data

US 2011/0170916 A1 Jul. 14, 2011

(30) Foreign Application Priority Data

Jan. 12, 2010 (WO) ..... PCT/JP2010/050225

(51) Int. Cl.
*G03G 15/06* (2006.01)

(52) U.S. Cl.
USPC ..... 399/274

(58) Field of Classification Search
USPC ..... 399/272–274; 430/122.1
See application file for complete search history.

(56) References Cited

U.S. PATENT DOCUMENTS

| | | | | |
|---|---|---|---|---|
| 5,446,526 | A * | 8/1995 | Shimizu | 399/276 |
| 6,021,295 | A * | 2/2000 | Ochiai et al. | 399/275 |
| 6,266,507 | B1 | 7/2001 | Nagahama | |
| 7,899,373 | B2 * | 3/2011 | Yamagishi et al. | 399/275 |
| 2004/0190947 | A1 | 9/2004 | Takeuchi | |
| 2006/0127136 | A1 | 6/2006 | Takeuchi | |
| 2008/0181676 | A1 * | 7/2008 | Yamagishi et al. | 399/275 |
| 2011/0176840 | A1 * | 7/2011 | Yamagishi et al. | 399/273 |

FOREIGN PATENT DOCUMENTS

| | | | |
|---|---|---|---|
| JP | 05-035067 | A | 2/1993 |
| JP | 05-158352 | A | 6/1993 |
| JP | 2000-098748 | A | 4/2000 |
| JP | 2004-302250 | A | 10/2004 |
| JP | 2004-317973 | A | 11/2004 |
| JP | 2005-092061 | A | 4/2005 |
| JP | 2005-275069 | A | 10/2005 |
| JP | 2008-185909 | A | 8/2008 |

* cited by examiner

*Primary Examiner* — Clayton E LaBalle
*Assistant Examiner* — Victor Verbitsky
(74) *Attorney, Agent, or Firm* — Canon USA Inc IP Division

(57) ABSTRACT

A repulsive magnetic field is formed in a section immediately upstream of a regulating blade, so that generation of a developing-agent stationary layer is suppressed or eliminated. Accordingly, a developing apparatus capable of stably maintaining the layer thickness of developing agent conveyed to a developing area for a long time is provided.

4 Claims, 9 Drawing Sheets

DEVELOPING APPARATUS

CROSS-REFERENCE TO RELATED APPLICATIONS

This application claims priority to International Patent Application No. PCT/JP2010/050225, filed Jan. 12, 2010, which is hereby incorporated by reference herein in its entirety.

BACKGROUND OF THE INVENTION

1. Field of the Invention

The present invention relates to, in particular, a developing apparatus mounted in an image forming apparatus that visualizes an electrostatic latent image with a developing agent including toner, the electrostatic latent image being formed on an image bearing member by electrophotography, an electrostatic recording method, or the like.

2. Description of the Related Art

An image forming apparatus using electrophotography according to the related art includes a developing apparatus that forms a toner image of an electrostatic latent image formed on a photosensitive member that serves as an image bearing member. The toner image is formed with toner included in a developing agent.

A most general developing apparatus includes a developing-agent container that contains the developing agent; a conveying member that conveys the developing agent contained in the developing-agent container while stirring and mixing the developing agent; a developing-agent bearing member that bears the developing agent and conveys the developing agent to a section that faces the photosensitive member; and a layer-thickness regulating member that regulates an amount of the developing agent on the developing-agent bearing member.

Here, a developing apparatus that uses two-component developing agent including non-magnetic toner and magnetic carrier will be described. The developing agent contained in the developing-agent container is stirred and mixed by a developing screw, which serves as the conveying member, in the developing-agent container. The developing agent is electrically charged as a result of frictional electrification in the stirring and mixing process. The charged developing agent is retained by a developing sleeve, which serves as the developing-agent bearing member, mainly by a magnetic force. A magnet having a plurality of magnetic poles that serves as magnetic-field generating means is disposed in the developing sleeve. The developing sleeve is disposed in a rotatable manner at a position where the developing sleeve faces the photosensitive member. As the developing sleeve rotates, the developing agent is conveyed to a developing area which faces the photosensitive member, and is used in a developing process. In the developing area, a developing bias is applied to the developing sleeve so that the toner included in the developing agent is caused to transfer to an electrostatic latent image formed on the surface of the photosensitive member. As a result, a toner image corresponding to the electrostatic latent image formed on the surface of the photosensitive member.

In the developing apparatus, a regulating blade, which serves as the layer-thickness regulating member, is generally disposed so as to face an outer peripheral surface of the developing sleeve with a predetermined gap provided therebetween. Various types of regulating blades, such as a magnetic plate, a non-magnetic plate, a combination of a magnetic plate and a non-magnetic plate, an elastic body, etc., have been proposed and put into practical use. In the process of conveying the developing agent retained by the developing sleeve to the developing area, the amount of developing agent conveyed to the developing area is regulated when the developing agent passes through the gap between the developing sleeve and the blade. Thus, an adjustment is made so that a stable amount of developing agent is supplied. One of the magnetic poles of the magnet (called a cutting pole) is disposed so as to face the regulating blade, so that the amount of developing agent is regulated while an accumulation of the developing agent is provided. With this structure, a certain amount of developing agent can be continuously accumulated at a section immediately upstream of the regulating blade. Therefore, the developing agent can be stably supplied to the developing sleeve.

CITATION LIST

Patent Literature

PTL 1: Japanese Patent Laid-Open No. 5-035067

PTL 2: Japanese Patent Laid-Open No. 2005-092061

However, in the developing apparatus that regulates the layer thickness of the developing agent on the surface of the developing sleeve with the regulating blade, problems described below may occur.

FIG. 17 is a schematic sectional view illustrating the state of two-component developing agent in a section upstream of a regulating blade in the case where the two-component developing agent is used according to the related art. The developing agent that has been carried up to a surface of a developing sleeve 128 is retained on the surface of the developing sleeve 128 and is conveyed to a position near a section upstream of the regulating blade in a conveying direction in which the developing agent is conveyed. The developing agent that has been conveyed to the position near the section upstream of the regulating blade 130 temporarily accumulates at that position. Then, some of the developing agent is conveyed to the developing area after the layer thickness thereof is regulated at a gap between an edge of the regulating blade 130 and the surface of the developing sleeve 128. The remaining developing agent that has not been allowed to pass through the gap accumulates at a section immediately upstream of the regulating blade 130, so that a layer in which the developing agent does not move (hereinafter called a developing-agent stationary layer) is formed. Thus, a developing-agent flowing layer in which the developing agent is conveyed as the developing sleeve 128 rotates and the developing-agent stationary layer in which the developing agent is blocked by the regulating blade 130 are formed at a position upstream of the regulating blade 130.

When the developing-agent flowing layer and the developing-agent stationary layer are formed, the developing-agent moving layer slides along the developing-agent stationary layer at a boundary surface therebetween. As a result, in the case where the two-component developing agent is used, the toner becomes separated from the carrier as a result of the sliding between the layers. In addition, the toner separated from the carrier becomes somewhat solidified by the frictional heat generated as a result of the sliding between the layers, and forms a toner layer at the boundary surface. The toner layer resides and grows to block the gap between the regulating blade 130 and the developing sleeve 128. Accordingly, the amount of developing agent that passes through the gap decreases. As a result, the amount of developing agent conveyed to the developing area varies and problems such as non-uniform density occur.

To solve the above-mentioned problems, it is effective to reduce the amount of developing agent supplied to the regulating blade and make the volume of the developing-agent stationary layer as small as possible by reducing the amount of developing agent that accumulates at the section near the regulating blade. However, if the amount of developing agent supplied to the regulating blade is reduced, a new problem easily arises that the amount of developing agent that passes through the gap cannot be stabilized. Therefore, it is necessary that a certain amount of developing agent be provided at the section upstream of the regulating blade, and it is difficult to completely eliminate the generation of the developing-agent stationary layer.

PTL 1 proposes a structure in which a columnar toner-conveying member is disposed at a position immediately upstream of the regulating blade to prevent the generation of the developing-agent stationary layer. The toner-conveying member constantly rotates while a constant gap is provided between the toner-conveying member and the developing sleeve.

According to PTL 1, the generation of the developing-agent stationary layer can be prevented. However, it is necessary to use bearings for supporting the toner-conveying member and driving means. Therefore, the structure is complex and high costs are unavoidably incurred. In addition, since the toner-conveying member and the developing-agent bearing member are driven in the opposite directions at a position where they face each other, a large stress is applied to the developing agent. Therefore, there is a risk that the developing agent will be degraded in a short time. In addition, in the case where the toner-conveying member is rotated at a high speed, there is also a risk that the developing agent will melt or be solidified by heat generated by the rotation.

PTL 2 proposes a structure in which a developing-agent-accumulation regulating member is disposed at position where the developing-agent stationary layer tends to be formed as a result of accumulation of the developing agent, so that the area where the developing-agent stationary layer is generated can be limited to a small area.

However, in the structure according to PTL 2, if the area of the developing-agent stationary layer is significantly large, a large developing-agent-accumulation regulating member must be used. Therefore, there may be a case in which the amount of developing agent at the section upstream of the regulating blade is excessively reduced. In such a case, as described above, the amount of developing agent supplied to the regulating blade is reduced and the problem that the amount of developing agent that passes through the gap cannot be stabilized easily arises. Thus, in order to solve the above-described problems, it is necessary to make the stationary layer smaller or eliminate the stationary layer.

SUMMARY OF INVENTION

The present invention has been made in view of the above-described problems, and an object of the present invention is to provide a developing apparatus capable of suppressing the generation of the developing-agent stationary layer in the section immediately upstream of the regulating member and stably maintaining the layer thickness of the developing agent conveyed to the developing area for a long time.

According to the present invention, a developing apparatus that develops a latent image formed on an image bearing member includes a rotatable developing-agent bearing member that bears developing agent including magnetic particles; a magnet disposed in the developing-agent bearing member and restraining the developing agent on a surface of the developing-agent bearing member; a regulating member that is spaced from the developing-agent bearing member by a predetermined distance, the regulating member regulating an amount of the developing agent on the surface of the developing-agent bearing member; and magnetic-field generating means disposed outside the developing-agent bearing member so as to face the developing-agent bearing member, the magnetic-field generating means generating a magnetic field in a direction such that the magnetic field cancels at least a normal component of a magnetic field generated from a surface of the magnet that faces an area of the developing-agent bearing member that is immediately upstream of the regulating member in a rotation direction of the developing-agent bearing member, the normal component being a component of the magnetic field in a normal direction of the developing-agent bearing member. The magnet includes a plurality of magnetic poles at the surface of the magnet, and the magnetic-field generating means is arranged such that the following expression is satisfied: $h<(A/(A+B))\times L$, where A (mT) is a magnitude of a magnetic flux density of a nearest magnetic pole, which is one of the plurality of magnetic poles that is nearest to the regulating member, B (mT) is a magnitude of a magnetic flux density on a surface of the magnetic-field generating means that faces the nearest magnetic pole, L (mm) is a distance between the nearest magnetic pole and the magnetic-field generating means, and h (mm) is a distance from the nearest magnetic pole to an area where the developing agent is not present along a line that connects the nearest magnetic pole and the magnetic-field generating means.

Further features of the present invention will become apparent from the following description of exemplary embodiments with reference to the attached drawings.

DESCRIPTION OF EMBODIMENTS

First Embodiment

Figure 1:
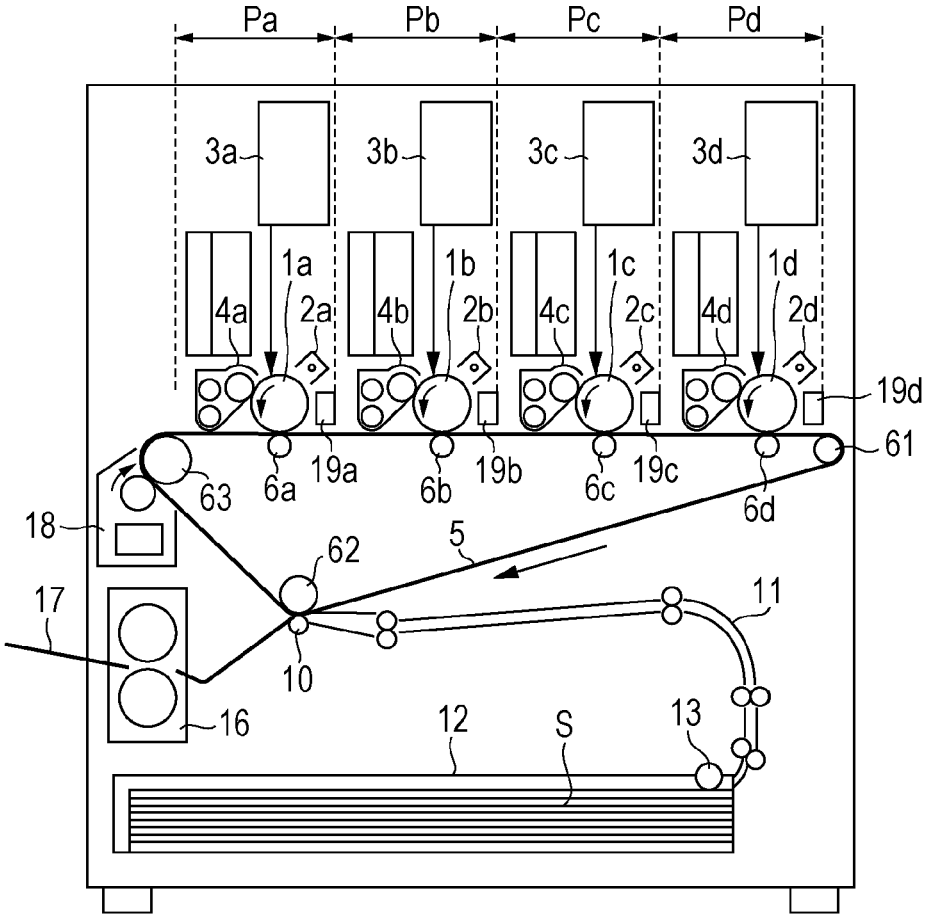
FIG. 1 is a schematic diagram illustrating the structure of an image forming apparatus according to a first embodiment of the present invention.

Hereinafter, the present invention will be described in detail on the basis of the embodiments illustrated in the drawings.

FIG. 1 is a schematic diagram illustrating the structure of a full-color image forming apparatus using electrophotography, which is an image forming apparatus according to an embodiment to which the present invention can be applied.

According to the present embodiment, the image forming apparatus includes four image forming sections P (Pa, Pb, Pc, and Pd). Each of the image forming sections Pa to Pd includes a photosensitive drum 1 (1*a*, 1*b*, 1*c*, and 1*d*), which is a drum-shaped electrophotographic photosensitive member that serves as an image bearing member and that rotates in a direction shown by the arrows (counterclockwise). A charging device 2 (2*a*, 2*b*, 2*c*, and 2*d*), a laser beam scanner (3*a*, 3*b*, 3*c*, and 3*d*) that serves as exposure means and that is disposed above the corresponding photosensitive drum 1 in the figure, and a developing apparatus 4 (4*a*, 4*b*, 4*c*, and 4*d*) are provided around each photosensitive drum 1. In addition, image forming means including a transfer roller 6 (6*a*, 6*b*, 6*c*, and 6*d*) and a cleaning device 19 (19*a*, 19*b*, 19*c*, and 19*d*) are also provided around each photosensitive drum 1.

The image forming sections Pa, Pb, Pc, and Pd have the same structure, and the photosensitive drums 1*a*, 1*b*, 1*c*, and 1*d* disposed in the image forming sections Pa, Pb, Pc, and Pd, respectively, also have the same structure. Therefore, the photosensitive drums 1*a*, 1*b*, 1*c*, and 1*d* are generically referred to as "photosensitive drums 1". Similarly, the image forming means disposed in the image forming sections Pa, Pb, Pc, and Pd also have the same structure in each image forming section. Therefore, the charging devices 2*a*, 2*b*, 2*c*, and 2*d*, the laser beam scanners 3*a*, 3*b*, 3*c*, and 3*d*, and the developing apparatuses 4*a*, 4*b*, 4*c*, and 4*d* are also generically referred to as the charging devices 2, the laser beam scanners 3, and the developing apparatuses 4, respectively. In addition, the transfer rollers 6*a*, 6*b*, 6*c*, and 6*d* and the cleaning devices 19*a*, 19*b*, 19*c*, and 19*d* are generically referred to as the transfer rollers 6 and the cleaning devices 19, respectively.

Next, an image forming sequence in the image forming apparatus having the above-described structure will be described.

First, the photosensitive drums 1 are uniformly charged by the charging devices 2. The photosensitive drums 1 rotate clockwise in the direction shown by the arrows at a process speed (peripheral speed) of, for example, 273 mm/sec.

The uniformly charged photosensitive drums 1 are subjected to scanning exposure with laser beams emitted from the laser beam scanners 3 and modulated in accordance with image signals. The laser beam scanners 3 include semiconductor lasers. The semiconductor lasers are controlled in accordance with document image information signals output from a document reading device including photoelectric conversion elements, such as CCDs, and are configured to emit the laser beams.

The surface potentials of the photosensitive drums 1 that have been charged by the charging devices 2 are changed in image sections so that electrostatic latent images are formed on the photosensitive drums 1. The electrostatic latent images are subjected to reversal development by the developing apparatuses 4. As a result, visual images, that is, toner images, are formed.

In the present embodiment, the developing apparatuses 4 use a two-component contact developing method in which a developing agent including toner and magnetic carrier that are mixed together is used as a developing agent including magnetic particles. However, if the toner includes magnetic bodies, effects of the present invention can be obtained even when a one-component developing method, in which only the toner is used as the developing agent, or a non-contact developing method is used. In the present embodiment, magnetic carrier particles are used as magnetic particles.

The above-described processes are formed in each of the image forming sections Pa, Pb, Pc, and Pd, so that four toner images of respective colors, which are yellow, magenta, cyan, and black, are formed on the photosensitive drums 1*a*, 1*b*, 1*c*, and 1*d*.

In the present embodiment, an intermediate transfer belt 5, which serves as an intermediate transfer member, is disposed below the image forming sections Pa, Pb, Pc, and Pd. The intermediate transfer belt 5 is stretched around rollers 61, 62, and 63, and is movable in a direction shown by the arrow.

The toner images on the photosensitive drums 1 (1*a*, 1*b*, 1*c*, and 1*d*) are temporarily transferred onto the intermediate transfer belt 5, which serves as the intermediate transfer member, by the transfer rollers 6 (6*a*, 6*b*, 6*c*, and 6*d*), which serve as first transfer means. Accordingly, the four toner images of the respective colors, which are yellow, magenta, cyan, and black, are superposed on the intermediate transfer member 5 such that a full-color image is formed. The toner that remains on each photosensitive drum 1 is collected by the corresponding cleaning device 19.

The full-color image on the intermediate transfer belt 5 is transferred onto a transfer medium S, such as paper, that has been fed from a paper feed cassette 12 by a paper feed roller 13 and conveyed along a paper feed guide 11. The full-color image is transferred by the operation of a second transfer roller 10 that serves as second transfer means. The toner that remains on the intermediate transfer belt 5 without being transferred is collected by an intermediate-transfer-belt cleaning device 18.

The transfer medium S onto which the toner image has been transferred is conveyed to a fixing device (heat-roller fixing device) 16, where the image is fixed. Then, the transfer medium S is ejected onto a paper ejection tray 17.

In the present embodiment, the photosensitive drums 1, which are commonly used drum-shaped organic photosensitive members, are used as the image bearing members. However, inorganic photosensitive members, such as amorphous silicon photosensitive members, may of course be used instead. Alternatively, belt-shaped photosensitive members may be used.

The charging method, the developing method, the transferring method, the cleaning method, and the fixing method are also not limited to the above-described methods.

Figure 2:
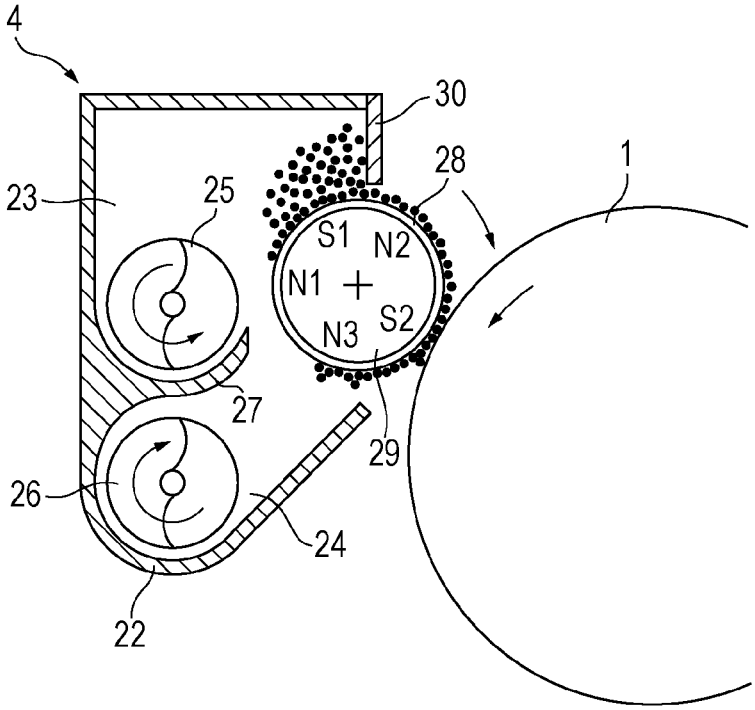
FIG. 2 is a diagram illustrating the structure of a developing apparatus included in the image forming apparatus according to the present invention.
Figure 3:
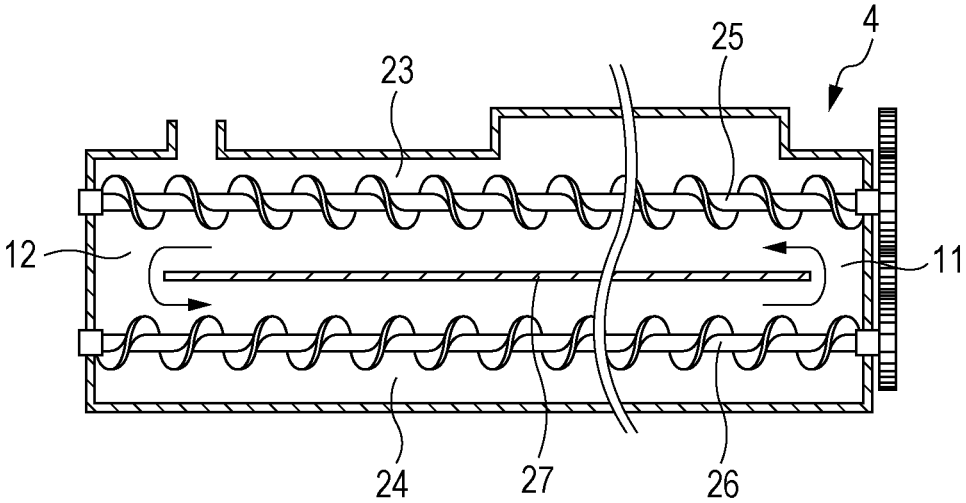
FIG. 3 is a diagram illustrating the structure of the developing apparatus included in the image forming apparatus according to the present invention.

Next, the operation of each developing apparatus 4 will be described with reference to FIGS. 2 and 3. FIGS. 2 and 3 are sectional views of each developing apparatus 4 according to the present embodiment.

Each developing apparatus 4 according to the present embodiment includes a developing-agent container 22. A two-component developing agent including toner and carrier is contained in the developing-agent container 22 as the developing agent. In addition, a developing sleeve 28 that serves as a developing-agent bearing member and a regulating blade 30 that serves as a regulating member for regulating chains of the developing agent retained on the developing sleeve 28 are disposed in the developing-agent container 22. The regulating blade 30 is opposed to the surface of the developing sleeve 28 with a predetermined space therebetween.

In the present embodiment, an inner space of the developing-agent container 22 is vertically sectioned into a developing chamber 23 and a stirring chamber 24 by a separation wall 27 that extends in a direction perpendicular to the figure at a substantially central section of the developing-agent container 22. The developing agent is contained in the developing chamber 23 and the stirring chamber 24.

First and second conveying screws 25 and 26 that serve as developing-agent stirring-and-conveying means are disposed in the developing chamber 23 and the stirring chamber 24, respectively. The first conveying screw 25 is disposed in a bottom section of the developing chamber 23 so as to extend substantially parallel to an axial direction of the developing sleeve 28. The first conveying screw 25 rotates in a direction shown by the arrow (counterclockwise) in the figure to convey the developing agent in the developing chamber 23 in one direction along the axial direction. The reason why the first conveying screw 25 is caused to rotate counterclockwise is because the developing agent can be effectively supplied to the developing sleeve 28 in such a case. The second conveying screw 26 is disposed in a bottom section of the stirring chamber 24 so as to extend substantially parallel to the first conveying screw 25. The second conveying screw 26 rotates in a direction opposite to the rotation direction of the first conveying screw 25 (clockwise) to convey the developing agent in the stirring chamber 24 in a direction opposite to the direction in which the first conveying screw 25 conveys the developing agent. Thus, the developing agent is conveyed by the rotation of the first and second conveying screws 25 and 26 and is thereby circulated between the developing chamber 23 and the stirring chamber 24 through openings (communicating sections) 11 and 12 provided at the ends of the separation wall 27.

In the present embodiment, the developing-agent container 22 has an opening at a position corresponding to the developing area that faces the photosensitive drum 1. The developing sleeve 28 is rotatably disposed in the opening such that a part of the developing sleeve 28 protrudes from the opening in a direction toward the photosensitive drum 1.

The diameter of the developing sleeve 28 is 20 mm, and the diameter of the photosensitive drum 1 is 80 mm. The shortest distance between the developing sleeve 28 and the photosensitive drum 1 is about 300 μm. Accordingly, a developing process can be performed while the developing agent that has been conveyed to the developing section is in contact with the photosensitive drum 1. The developing sleeve 28 is formed of a non-magnetic material, such as aluminum or stainless steel, and a magnet roller 29, which serves as magnetic-field means, is disposed in the developing sleeve 28 in a non-rotatable manner. The magnet roller 29 includes a developing pole S2 that is positioned so as to face the photosensitive drum 1 in the developing section. The magnet roller 29 also includes a magnetic pole S1 positioned so as to face the regulating blade 30, a magnetic pole N2 positioned between the magnetic poles S1 and S2, and magnetic poles N1 and N3 positioned so as to face the developing chamber 23 and the stirring chamber 24, respectively. Magnitudes of magnetic flux densities of the magnetic poles are in the range of 40 mT to 70 mT, except a magnitude of a magnetic flux density of the pole S2 used in the developing process is 100 mT.

Thus, the developing sleeve 28 rotates in the direction shown by the arrow (clockwise) in the developing process, and retains the two-component developing agent while the layer thickness of the developing agent is regulated by the regulating blade 30 that performs chain-cutting of a magnetic brush. The developing sleeve 28 conveys the developing agent retained thereon to the developing area in which the developing sleeve 28 faces the photosensitive drum 1, and supplies the developing agent to the electrostatic latent image formed on the photosensitive drum 1. Thus, the latent image is developed. To increase the developing efficiency, that is, the rate at which the toner adheres to the latent image, a developing bias voltage in which a direct-current voltage and an alternating-current voltage are superposed provided from a power source is applied to the developing sleeve 28. In the present embodiment, a −500 V direct-current voltage and an alternating-current voltage having a peak-to-peak voltage Vpp of 800 V and a frequency f of 12 kHz are superposed. However, the value of the direct-current voltage and the waveform of the alternating-current voltage are not limited to this. In general, in a two-component magnetic-brush developing method, the developing efficiency increases and the image quality improves when the alternating-current voltage is applied. However, fog is easily generated. Therefore, the generation of fog is prevented by setting a potential difference between the direct-current voltage applied to the developing sleeve 28 and the charging potential of the photosensitive drum 1 (that is, the potential at blank areas).

In the developing area, the developing sleeve 28 included in the developing apparatus 4 moves in the same direction as the moving direction of the photosensitive drum 1. The ratio of the peripheral speed of the developing sleeve 28 to that of the photosensitive drum 1 is 1.75. The peripheral speed ratio is set in the range of 0 to 3.0, and is preferably set in the range of 0.5 to 2.0. The developing efficiency increases as the moving speed ratio increases. However, if the ratio is excessively increased, problems such as scattering of the toner and degradation of the developing agent occur. Therefore, the ratio is preferably set within the above-described range.

The regulating blade 30, which serves as a chain-cutting member, includes a non-magnetic member 30 formed of a plate-shaped aluminum member or the like that extends along the axial line in the longitudinal direction of the developing sleeve 28. The regulating blade 30 is disposed upstream of the photosensitive drum 1 in the rotation direction of the developing sleeve. Both the toner and the carrier pass through the gap between an end portion of the regulating blade 30 and the developing sleeve 28 and are conveyed to the developing area. The space (gap) between the regulating blade 30 and the surface of the developing sleeve 28 is adjusted so that the amount of chain cutting of the developing-agent magnetic brush retained on the developing sleeve 28 is regulated and the amount of developing agent conveyed to the developing area is adjusted. In the present embodiment, the amount of developing agent with which a unit area of the developing sleeve 28 is coated is regulated to 30 mg/cm$^2$ by the regulating blade 30. In the present embodiment, of the magnetic poles in the magnet disposed in the developing sleeve, the magnetic pole that is nearest to the regulating blade (cutting pole) is positioned upstream of the regulating blade in the rotation direction of the developing sleeve. With this structure, the amount of developing agent is regulated while an accumulation of the developing agent is formed in a section that faces the regulating blade. In this structure, a certain amount of developing agent can be continuously accumulated in a section immediately upstream of the regulating blade. Therefore, the developing agent can be stably supplied to the developing sleeve.

The distance between the regulating blade 30 and the developing sleeve 28 is in the range of 200 to 1,000 μm, more preferably, in the range of 300 to 700 μm. In the present embodiment, the distance is set to 500 μm.

Figure 17:
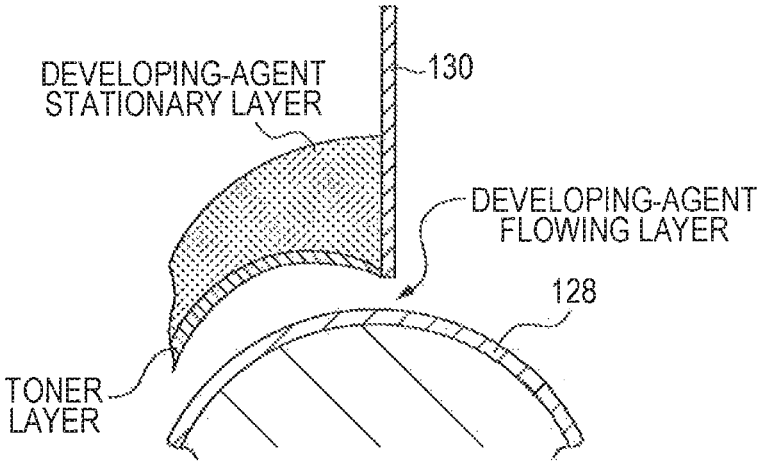
FIG. 17 is a diagram illustrating a developing apparatus according to a related art.

Before describing in more detail the movement of the developing agent in a section upstream of the regulating blade, which is a characteristic part of the present embodiment, movement of the developing agent in a section upstream of a regulating blade in a structure according to the related art will be described. FIG. 17 is a schematic sectional view illustrating the state of two-component developing agent in a section upstream of a regulating blade according to the related art.

The developing agent that has been carried up to the surface of a developing sleeve 128 is retained on the surface of the developing sleeve 128 and is conveyed to a position near a section upstream of a regulating blade 130 in a conveying direction in which the developing agent is conveyed. The developing agent that has been conveyed to the position near the section upstream of the regulating blade 130 temporarily accumulates at that position. Then, some of the developing agent is conveyed to the developing area after the layer thickness thereof is regulated at a gap between an edge of the regulating blade 130 and the surface of the developing sleeve 128. The remaining developing agent that has not been allowed to pass through the gap accumulates at the section upstream of the regulating blade 130, and forms a developing-agent stationary layer. Thus, as described above in the related art section, a developing-agent flowing layer in which the developing agent is conveyed as the developing sleeve 128 rotates and the developing-agent stationary layer in which the developing agent is blocked by the regulating blade 130 are formed at a position upstream of the regulating blade 130.

When the developing-agent flowing layer and the developing-agent stationary layer are formed, the developing-agent moving layer slides along the developing-agent stationary layer at a boundary surface therebetween. As a result, the toner becomes separated from the carrier as a result of the sliding between the layers. In addition, the toner separated from the carrier becomes somewhat solidified by the frictional heat generated as a result of the sliding between the layers, and forms a toner layer at the boundary surface. The toner layer resides and grows to block the gap between the regulating blade 130 and the developing sleeve 128. Accordingly, the amount of developing agent that passes through the gap decreases. As a result, as described above in the related art section, the amount of developing agent conveyed to the developing area varies and problems such as non-uniform density occur.

As a countermeasure against the above-described problems, the generation of the developing-agent stationary layer itself may be suppressed. In such a case, the boundary surface between the developing-agent stationary layer and the developing-agent flowing layer can be eliminated, so that the toner layer, of course, is not generated. However, to make the amount of developing agent on the developing sleeve 128 somewhat stable, it is necessary that a certain amount of developing agent be provided in the section behind the regulating blade 130. In this case, it is difficult to prevent the developing agent that has not been allowed to pass through the gap between the regulating blade 30 and the developing sleeve 128 from forming the developing-agent stationary layer. Therefore, it is difficult to completely eliminate the generation of the developing-agent stationary layer itself.

However, even when the generation of the developing-agent stationary layer itself cannot be completely eliminated, a certain effect can be obtained if the boundary surface between the developing-agent stationary layer and the developing-agent flowing layer is disposed at a position distant from the developing sleeve 28. This is because in such a case, even if the solidified toner layer is generated at the boundary surface, the toner layer does not block the gap between the regulating blade 30 and the developing sleeve 28 and can be prevented from causing no problem. Even if a problem occurs, the time before the occurrence of the problem can be considerably increased. Therefore, the cartridge life and the maintenance interval can be increased. This is advantageous for users and servicemen.

Therefore, according to the present invention, instead of eliminating the generation of the developing-agent stationary layer itself, the problems are solved or alleviated by activating the movement of the developing agent in the area where the developing-agent stationary layer has conventionally been formed. The movement of the developing agent in the area where the developing-agent stationary layer has conventionally been formed can be activated by changing the magnet pattern of the magnet roller in the developing sleeve. However, to achieve both the activation of the developing agent and the original function of the developing sleeve, that is, the function of stably conveying the developing agent to the developing area while regulating the amount of the developing agent, it is more preferable to activate the movement of the developing agent using a structure other than the magnet roller in the developing sleeve. Therefore, according to the present invention, a magnet is disposed outside the developing sleeve. The magnet generates a magnetic field which acts on a magnetic field generated by the developing sleeve 28 in a section immediately upstream of the regulating blade 30 in the rotation direction of the developing sleeve 28 and which cancels at least a component of the magnetic field in the normal direction with respect to the developing sleeve 28. More specifically, the magnet is arranged such that a pole of the magnet that has the same polarity as that of a magnetized area on the surface of the magnet roller 29 that faces the inner surface of the developing sleeve 28 at a position immediately upstream of the regulating blade 30 faces the magnetized area. In this case, the above-described problems can be solved by activating the movement of the developing agent in the area where the developing-agent stationary layer has conventionally been formed.

Figure 4:
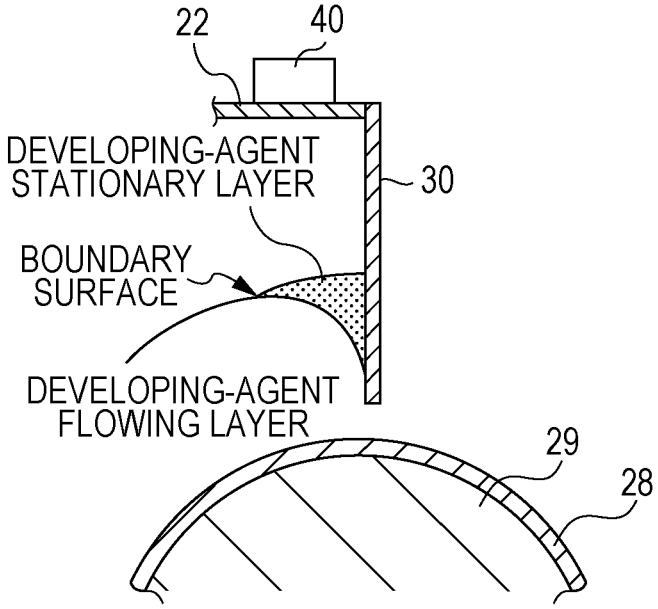
FIG. 4 is a diagram illustrating a section immediately upstream of a regulating blade included in the developing apparatus according to the present invention.

FIG. 4 is a schematic sectional view illustrating the state of the two-component developing agent in the section upstream of the regulating blade according to the present embodiment. A magnet 40, which serves as magnetic-field generating means, is disposed so as to extend along the axial line in the longitudinal direction of the developing sleeve 28. In this structure, the developing agent that has been conveyed by the developing sleeve 28 to the section upstream of the regulating blade 30 and that has accumulated in this section flows at a speed higher than that in the structure of the related art illustrated in FIG. 17 that is free from the magnet. In addition, the stationary layer is considerably smaller than that in the structure of the related art illustrated in FIG. 17.

Before describing in detail the reason why the developing agent in the area where the developing-agent stationary layer has conventionally been formed can be activated by placing the magnet, the manner in which the developing-agent stationary layer is formed in the structure of the related art that is free from the magnet will be described.

In the section upstream of the regulating blade 30, the conveyance speed of the developing agent is generally highest at a position near the developing sleeve 28, and decreases as a distance from the developing sleeve 28 increases. The conveyance speed eventually decreases to zero, and the developing-agent stationary layer is formed accordingly. The reason why the conveyance speed of the developing agent decreases as a distance from the developing sleeve 28 increases can be understood by considering the force applied to the developing agent layers in the section upstream of the regulating blade 30.

Figure 5A:
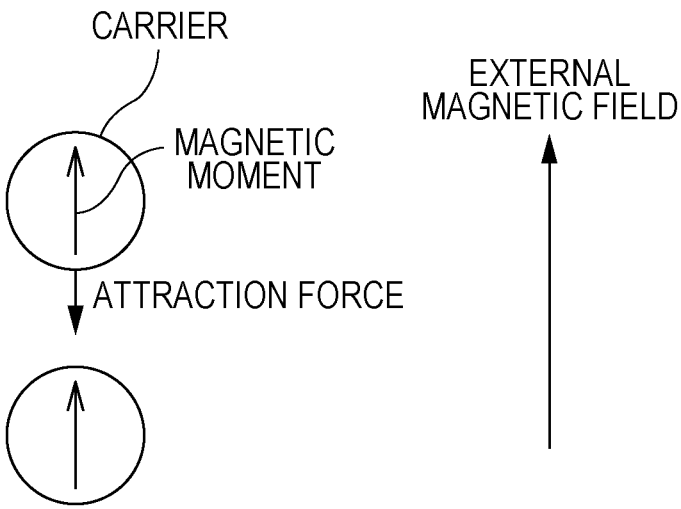
FIG. 5A is a diagram illustrating a magnetic interaction between carrier particles.
Figure 5B:
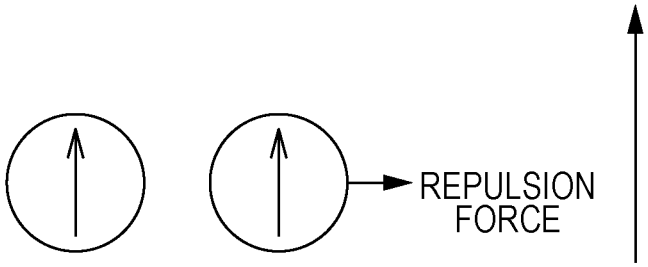
FIG. 5B is a diagram illustrating a magnetic interaction between the carrier particles.
Figure 5C:
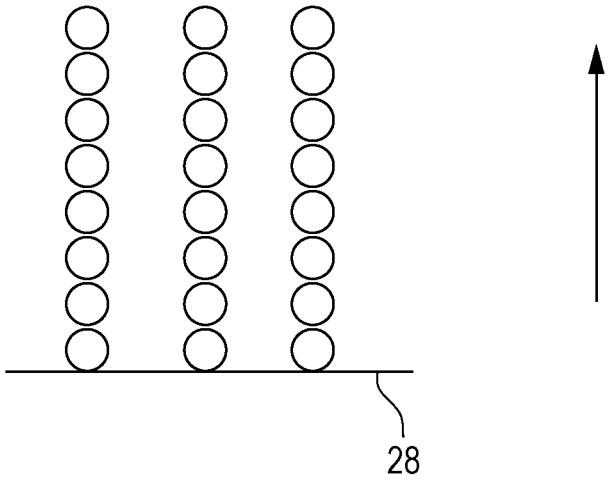
FIG. 5C is a diagram illustrating a magnetic interaction between the carrier particles.

The developing agent in the section upstream of the regulating blade 30 receives a driving force when the developing sleeve 28 rotates, and is conveyed by the driving force. The developing agent that is in contact with the developing sleeve 28 is conveyed by the driving force that is directly received from the developing sleeve 28. In addition, in the case where the developing agent including a magnetic material, such as carrier, is placed in the magnetic field, chains of the developing agent are formed by the magnetic field and the developing agent tends to move in lumps. Therefore, when the developing agent at the bottom of the chains comes into contact with the developing sleeve and is conveyed, the developing agent that is not in contact with the developing sleeve also receives the driving force and is conveyed. This will be described in more detail. When the magnetic material, for example, carrier, is disposed in the magnetic field, a magnetic moment is induced in each carrier particle by the external magnetic field and the magnetic moments induced in the carrier particles interact. Here, two carrier particles that are placed in the external magnetic field are considered. In this case, a magnetic moment is induced in each carrier particle in the direction of the magnetic field. As illustrated in FIG. 5A, when the carrier particles are arranged such that the magnetic moments are linearly aligned (when the carrier particles are arranged along the magnetic lines of force), a strongest attraction force is applied. As illustrated in FIG. 5B, when the carrier particles are arranged such that the magnetic moments are in parallel (when the carrier particles are arranged in a direction perpendicular to the magnetic lines of force), a strongest repulsion force is applied. The attraction force and the repulsion force are equivalent to or greater than the attraction force applied by the external magnetic field. Therefore, as illustrated in FIG. 5C, the carrier particles in the magnetic field are arranged next to each other to form lines that extend along the magnetic lines of force while the lines are spaced from each other owing to the repulsion force applied thereto. In other words, chains of carrier particles are formed. The carrier particles in the chains formed by the magnetic interaction are in the lowest energy level (most stable) in the state in which the chains are formed. Therefore, the carrier particles tend to move while maintaining the form of the chains. Therefore, when the developing agent that is in contact with the developing sleeve 28 at the bottom of the chains is moved by the rotation of the developing sleeve 28, the developing agent that is not in contact with the developing sleeve 28 also receives the driving force.

This explanation may imply that the conveyance speed of the developing agent at a position close to the developing sleeve 28 is the same as that of the developing agent at a position distant from the developing sleeve 28 as long as the chains are formed. However, in practice, the conveyance speed of the developing agent decreases as the distance from the developing sleeve 28 increases in the section upstream of the regulating blade 30 where the developing agent accumulates. The conveying force eventually decreases to zero, and the stationary layer is formed. This is because, since the developing agent receives the magnetic force (attraction force) from the magnet roller 29 and is pressed by the weight of the developing agent in other areas, friction is generated by the pressing force (vertical stress). This will now be described in more detail.

Figure 6:
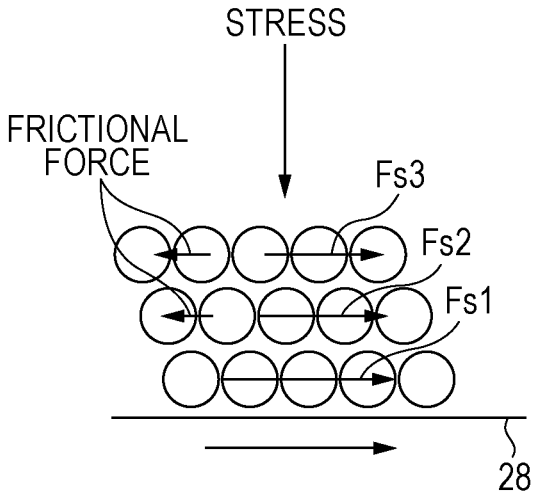
FIG. 6 is a diagram illustrating driving force applied by a developing sleeve.

Referring to FIG. 6, a first carrier layer and a second carrier layer arranged in that order on the developing sleeve 28 will be considered. When Fs is the driving force applied to the first carrier layer by the developing sleeve 28, it may seem, from the above-described behavior of the chains due to the magnetic interaction between the carrier layers, that the driving force Fs is also applied to the second layer of carrier particles. However, since a frictional force generated by the vertical stress (above-described pressing force) is applied to the developing-agent layers, a driving force Fs2 applied to the second layer is smaller than a driving force Fs1 applied to the first layer by the amount corresponding to the frictional force $\mu\sigma$. Similarly, a frictional force Fs3 applied to a third layer is smaller than Fs2 by the amount corresponding to the frictional force. This also applies to fourth and the following layers. Thus, the driving force Fs applied to the slip planes by the developing sleeve 28 decreases as the distance from the developing sleeve increases. Accordingly, the conveyance speed of the developing agent decreases as the distance from the developing sleeve increases. As a result, the conveying force eventually decreases to zero, and the stationary layer is formed.

The frictional force $\mu\sigma$ will now be described. The frictional force increases in proportion to a pressing force (vertical stress) $\sigma$. The vertical stress $\sigma$ is basically the sum of a normal component Fr of the magnetic force applied to the developing agent by the magnet roller 29 and the weight W (=mg) applied to the developing agent by the developing agent in other areas. The normal component Fr is a component of the magnetic force in a direction perpendicular to the surface of the developing sleeve 28. The frictional coefficient $\mu$ is generally expressed as tan $\phi$, where $\phi$ is often called an internal friction angle. According to the definition of $\phi$, the internal friction angle is equivalent to the angle of rest for the developing agent. The angle of rest is an angle at which sliding of the developing agent is started.

As described above, owing to the behavior of the chains generated by magnetic interaction between the carrier layers, when the driving force is applied to the developing agent that is in contact with the developing sleeve 28 by the rotation of the developing sleeve 28, the developing-agent layers try to move together. However, in practice, since the frictional force is generated by the pressing force (vertical stress) with which the developing-agent layers are pressed against the developing sleeve 28, the conveyance speed of the developing agent decreases as the distance from the developing sleeve 28 increases, and eventually the stationary layer is formed. The vertical stress is basically the sum of the normal component Fr of the magnetic force applied to the developing agent and the weight applied to the developing agent.

Accordingly, it can be expected that, if the magnetic force or the weight applied to the developing agent is changed, the manner in which the stationary layer is formed can also be changed. With regard to the weight applied to the developing agent, it may seem that the volume of the stationary layer can be reduced by reducing the amount of accumulation of the developing agent. However, as described above, there is a risk that the developing sleeve cannot be coated with the developing agent in a stable manner if the amount of accumulation of the developing agent is reduced. Therefore, according to the present invention, a magnet that serves as the magnetic-field generating means is provided to change the magnetic force applied to the developing agent, thereby activating the movement of the developing agent. More specifically, the vertical stress that causes the generation of the stationary layer is reduced by reducing the normal component Fr of the magnetic force applied to the developing agent. The magnetic force applied to the developing agent will now be described in detail.

Figure 7:
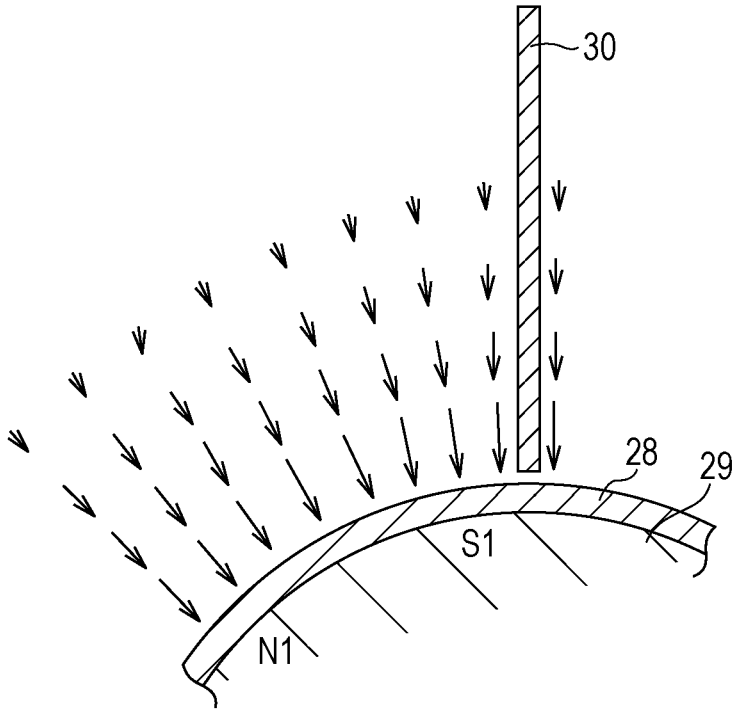
FIG. 7 is a schematic diagram illustrating magnetic force applied to a developing agent according to a related art.

First, the case in which the magnet is not provided as in the structure of the related art will be described as a comparative example. FIG. 7 schematically illustrates the magnetic force applied to the developing agent by the magnet roller 29 in the case of the comparative example in which the magnet is not provided as in the structure of the related art. The arrows indicate the directions in which the force is applied. The lengths of the arrows indicate the magnitudes of the force. As is clear from this figure, the magnetic force applied to the developing agent is substantially directed toward the magnet roller 29 irrespective of the position. When the magnetic force is divided into a tangential component Fθ along the surface of the developing sleeve 28 and the normal component Fr, the magnetic force substantially includes only the normal component Fr. The normal component Fr of the magnetic force serves as the vertical stress as described above, and generates the frictional force applied to the developing agent as a result. The tangential component Fθ of the magnetic force does not serve as the vertical stress, but serves to activate the movement of the developing agent. However, in the structure of the related art illustrated in FIG. 7 in which the magnet is not provided, it is clear that Fθ is extremely small.

Figure 8:
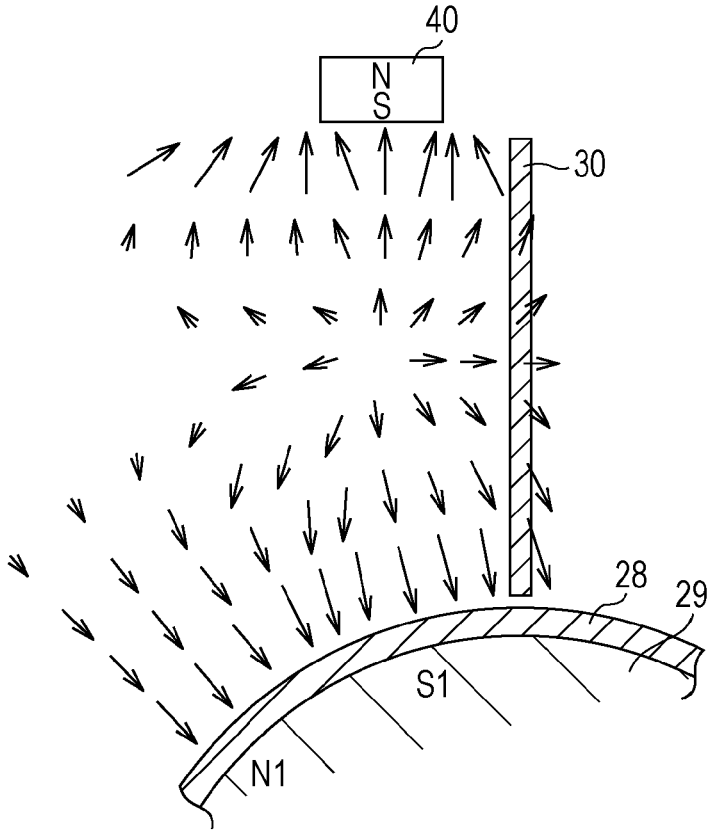
FIG. 8 is a schematic diagram illustrating magnetic force applied to the developing agent according to the present embodiment.

FIG. 8 schematically illustrates the magnetic force applied to the developing agent by the magnet roller 29 in the structure of the present embodiment in which the magnet 40 that serves as the magnetic-field generating means is added to the structure of the related art. The magnet is magnetized such that the magnet has an S surface at one side and an N surface at the other side, and is disposed so as to extend along the axial line in the longitudinal direction of the developing sleeve 28. The magnet 40 is arranged such that poles having the same polarity face each other so as to form a repulsive magnetic field between the magnet 40 and the pole in the magnet roller 29 at a position immediately upstream of the regulating blade 30 (hereinafter referred to as a cutting pole). More specifically, the magnet is arranged such that the S-pole surface thereof and the cutting pole S1, which have the same polarity, substantially face each other. The reason for this will be described below. As is clear from the figure, unlike the structure of the related art in which the magnet 40 is not provided and in which the magnetic force is directed substantially toward the magnet roller 29, in the present embodiment, the magnetic force is applied also in the tangential direction, owing to the effects of the magnet 40. As described above, although the normal component Fr of the magnetic force serves as the vertical stress and generates the frictional force as a result, the tangential component Fθ serves to activate the movement of the developing agent. Therefore, it can be expected that the developing agent in the area where the stationary layer has conventionally been formed will start to move owing to the effects of the magnet 40. In practice, the inventors of the present invention have confirmed that the area of the stationary layer can be reduced. Thus, the advantages of the present invention have been obtained. In addition, in the structure of the present embodiment, the normal component Fr of the magnetic force can be reduced within a shorter distance than that in the structure of the related art. Therefore, the vertical stress, which causes the generation of the stationary layer, can be reduced.

The arrangement of the magnet 40 will now be described. It is necessary that the magnet 40 be disposed so as to form the repulsive magnetic field together with the pole (cutting pole) disposed in the magnet roller at a position immediately upstream of the regulating blade. Therefore, as described above, the magnet is preferably arranged such that the pole having the same polarity as that of the cutting pole faces the cutting pole. This will be described in more detail.

Figure 9:
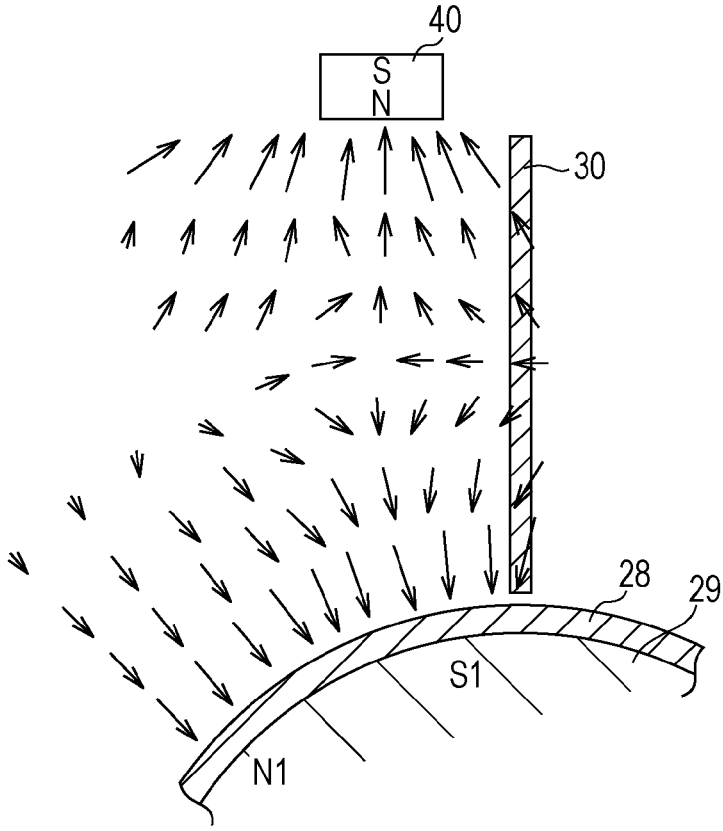
FIG. 9 is a schematic diagram illustrating magnetic force applied to the developing agent according to a comparative example.

FIG. 9 schematically illustrates, as a comparative example, the magnetic force applied to the developing agent when the magnet 40 is arranged such that the N-pole surface that has the polarity opposite to that of the cutting pole S1 substantially faces the cutting pole S1. As is clear from this figure, also in this comparative example, the magnetic force is applied not only in the normal direction but also in the tangential direction owing to the effects of the magnet 40. Therefore, it can be expected that the movement of the developing agent can be accelerated by the tangential component Fθ of the magnetic force. However, in practice, the inventors of the present invention have confirmed that the movement of the developing agent has been somewhat deactivated.

The reason for this can be easily understood by comparing this example with the structure of the present embodiment illustrated in FIG. 8. As illustrated in FIG. 8, in the case where the poles having the same polarity substantially face each other, the magnetic force is applied outward in directions away from the area between the cutting pole S1 of the magnet roller 29 and the magnet 40. In contrast, as illustrated in FIG. 9, in the case where the poles having the opposite polarities substantially face each other, the magnetic force is applied inward toward the area between the cutting pole S1 of the magnet roller 29 and the magnet 40. The magnetic force serves as a strong attraction force. Therefore, a large amount of developing agent is attracted to the area between the magnet roller 29 and the magnet 40, and is restrained from moving. Therefore, when the poles having the opposite polarities substantially face each other, the developing agent becomes stationary. As a result, the volume of the stationary layer is increased when the magnet 40 is provided.

In contrast, in the case where the poles having the same polarity face each other as in the structure of the embodiment illustrated in FIG. 8, the magnetic force is applied radially outward. Therefore, unlike the case in which the poles having the opposite polarities substantially face each other, the developing agent can be prevented from being attracted and restrained from moving. Here, it is important that the repulsive magnetic field be formed. This is because the repulsion force generated by the repulsive magnetic field activates the movement of the developing agent without causing the developing agent to be strongly attracted or restrained. Therefore, to solve the problems to be solved by the present invention, it is necessary to arrange the magnet such that the repulsive magnetic field is formed. Even if the poles having the same polarity do not entirely face each other, the effects of the present invention can be obtained as long as the repulsive magnetic field is formed. In addition, as long as the repulsive magnetic field is formed, the magnet may be disposed at a position downstream of the regulating blade in the conveying direction of the developing agent. Conversely, even if the magnet is used, the effects of the present invention cannot be sufficiently obtained if the magnet is arranged such that a strong attraction force is generated, as in the case where the poles having the opposite polarities face each other.

To be precise, the arrangement of the magnet such that the repulsive magnetic field is generated is the arrangement in which the magnet is disposed so as to form a magnetic field that is repulsive, that is, the arrangement in which an area where the magnitude of the magnetic flux density is substantially zero is provided between the magnet and the magnet roller. When the repulsive magnetic field is not formed, lines of strong magnetic force are provided between the magnet and the magnet roller, and the magnitude of the magnetic flux density in the area between the magnet and the magnet roller is larger than that in the surrounding areas. In such a case, the developing agent is strongly attracted to the area between the magnet and the magnet roller. The magnitude of the magnetic flux density can be measured by a method described below. Therefore, it can be confirmed whether or not the magnet is disposed so as to form the repulsive magnetic field by measuring the magnitude of the magnetic flux density.

The arrangement of the magnet will now be further described. Even when the magnet is disposed so as to form the repulsive magnetic field, that is, such that the pole having the same polarity as that of the cutting pole of the magnet roller substantially faces the cutting pole, if the magnet is too close to the cutting pole, there is a possibility that the volume of the stationary layer will increase. This is because when the magnet is disposed near the magnetic pole of the magnet roller, the additionally provided magnet itself serves to restrain a part of the developing agent in the section upstream of the regulating blade.

In the case where the magnet is provided, a magnetic force in a direction toward the magnet is additionally generated in the space between the magnet and the magnet roller even when the magnet is disposed so as to form the repulsive magnetic field. If the developing agent is attracted by the magnetic force and adheres to the magnet, the developing agent remains on the magnet and forms a new stationary layer. Even if the magnet is disposed outside the developing-agent container so that the developing agent does not come into direct contact with the magnet, the developing agent adheres to the developing-agent container at a position corresponding to the magnet and a similar problem occurs. If a mechanism similar to the developing sleeve, which conveys the developing agent attracted to the magnet roller by moving the surface thereof, is provided, the developing agent can be removed and be prevented from accumulating.

Accordingly, in the present invention, generation of the magnetic force in the direction toward the magnet is prevented in an area where the developing agent is present in the section upstream of the regulating blade. More specifically, the above-described problems are solved by arranging the magnet while adjusting the magnitude of the magnetic force and the position of the magnet. This will now be described in more detail.

Figure 10:
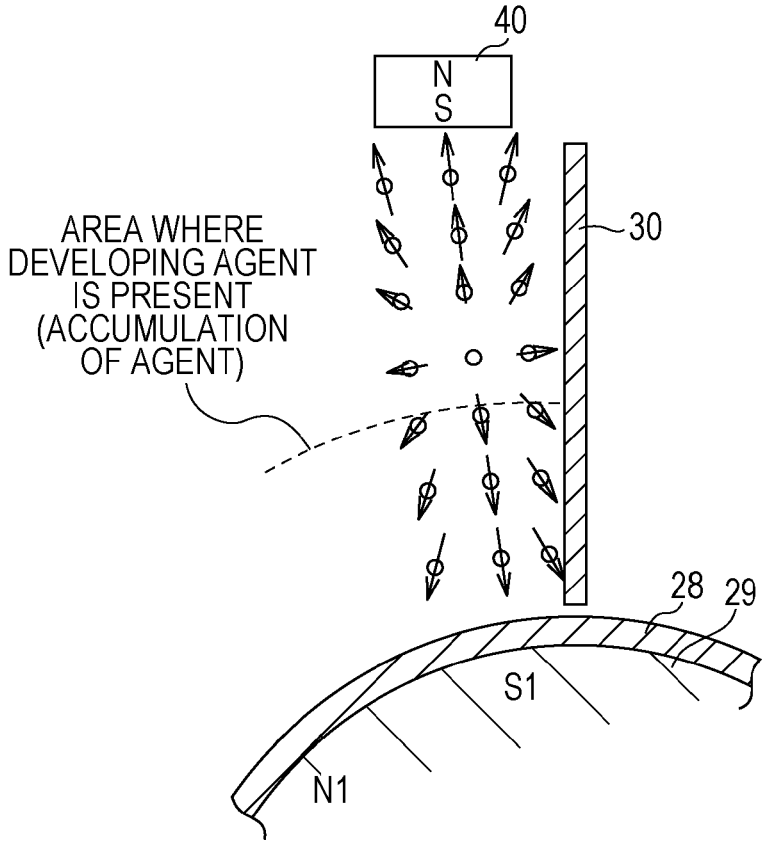
FIG. 10 is a schematic diagram illustrating magnetic force applied to the developing agent according to the present embodiment.

FIG. 10 illustrates the magnetic force applied to the carrier included in the developing agent in the case where the magnet 40 is disposed at a distance of 45 mm from the developing sleeve 28. The size of the cross-section of the magnet 40 is 4 mm in the vertical direction and 8 mm in the horizontal direction. The magnitude of the magnetic flux density is substantially the same as that of the cutting pole S1. In the present embodiment, the magnitude of the magnetic flux density of the cutting pole S1 is about 50 mT. Therefore, the magnitude of the magnetic flux density of the magnet is also set to 50 mT. In this case, it is assumed that the accumulation of the developing agent in the section upstream of the regulating blade extends so as to cover an area that is spaced from the sleeve by about 20 mm. As is clear from FIG. 10, in this example, the area in which the magnetic force is applied to the carrier in the developing agent in the direction toward the magnet 40 is not included in the area where the developing agent is present (accumulation of the developing agent). Therefore, in this example, the developing agent can be prevented from being restrained by the magnet 40 and becoming stationary. Even when the developing agent adheres to the magnet, the amount of developing agent that adheres to the magnet is small.

Figure 11:
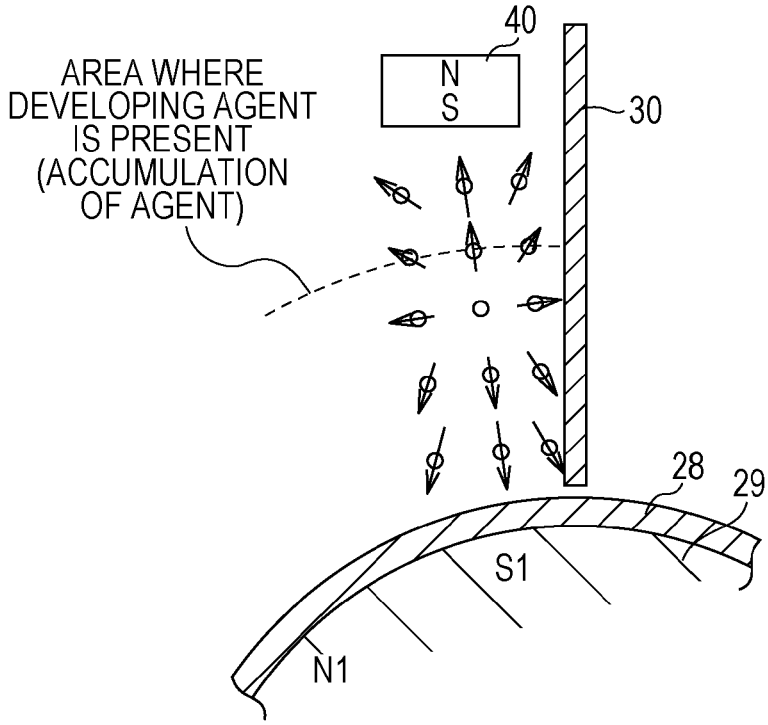
FIG. 11 is a schematic diagram illustrating magnetic force applied to the developing agent according to a comparative example.

FIG. 11 illustrates, as a comparative example, the magnetic force applied to the carrier included in the developing agent in the case where the magnet 40 is moved toward the developing sleeve 28 to a position at a distance of 30 mm from the developing sleeve 28. Conditions other than the arrangement of the magnet 40 are similar to those in the above-described example. As is clear from FIG. 10, in this example, the area in which the magnetic force is applied to the carrier in the developing agent in the direction toward the magnet is included in the area where the developing agent is accumulated. Therefore, a part of the developing agent in the area where the developing agent is accumulated is attracted by the magnet and is restrained. Although the developing agent is constantly supplied to the area where the developing agent is accumulated, the supplied developing agent is restrained by the magnet and becomes stationary. As a result, the stationary layer is formed in the area where the developing agent is restrained and the effects of the present invention cannot be sufficiently obtained.

Figure 12:
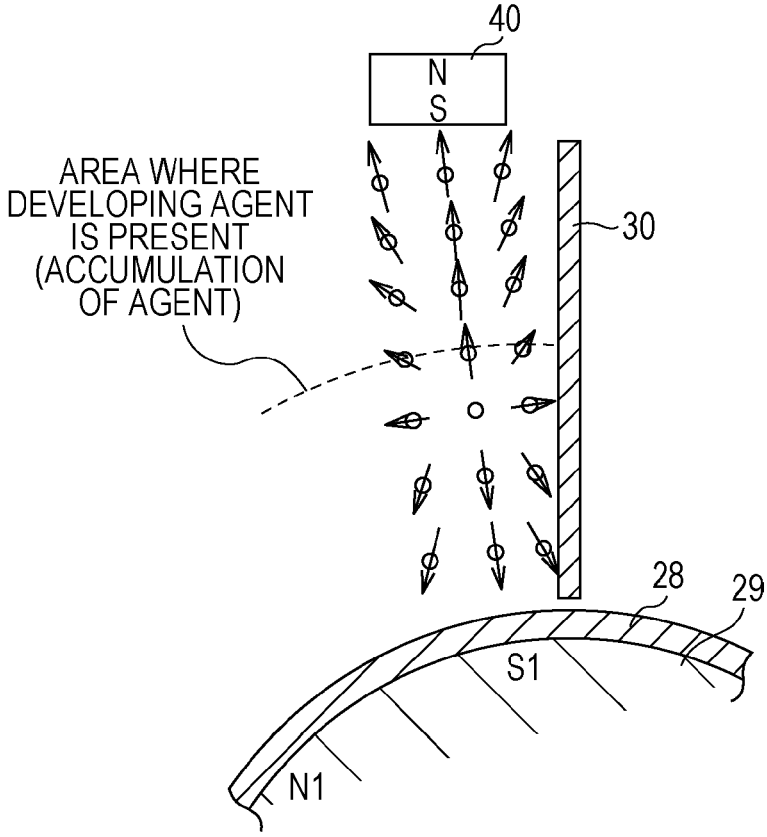
FIG. 12 is a schematic diagram illustrating magnetic force applied to the developing agent according to another comparative example.

FIG. 12 illustrates, as another comparative example, the magnetic force applied to the carrier included in the developing agent in the case where the magnet 40 is not moved from the position at the distance of 45 mm but the magnitude of the magnetic flux density of the magnet 40 is changed to 100 mT. In this case, the magnetic force of the magnet 40 is larger than that of the cutting pole S1. Therefore, the area where the attraction force is applied in the direction toward the magnet extends further toward the position of the magnet roller. Therefore, the area in which the magnetic force is applied to the carrier in the developing agent in the direction toward the magnet 40 is included in the area where the developing agent is accumulated. Accordingly, a part of the developing agent in the area where the developing agent is accumulated is attracted to and retained by the magnet 40. As a result, similar to the comparative example described above with reference to FIG. 11, the stationary layer is formed in the area where the developing agent is restrained and the effects of the present invention cannot be sufficiently obtained.

As is clear from the above-described examples, the generation of the stationary layer can be suppressed by adjusting the position of the magnet and the magnitude of the magnetic flux density of the magnet so that the area where the magnetic force is applied to the developing agent in the direction toward the magnet is not included in the area where the developing agent is accumulated.

To prevent the area where the magnetic force is applied to the developing agent in the direction toward the magnet from being included in the area where the developing agent is accumulated, the magnet can be positioned as far as possible from the area where the developing agent is accumulated, so that the accumulated developing agent is not affected by the attraction force of the magnet. However, when the magnet is disposed at a position distant from the area where the developing agent is accumulated, it is difficult to obtain the effects of the present invention. Therefore, the magnitude of the magnetic flux density of the magnet is preferably large. However, if the magnitude of the magnetic flux density of the magnet is excessively large, there is a possibility that the magnetic force in the direction toward the magnet will be applied to the developing agent in the area where the developing agent is accumulated, as described above. The effects of the present invention can be reliably obtained by increasing the magnitude of the magnetic flux density of the magnet within a range in which the area where the magnetic force is applied in the direction toward the magnet is not included in the area where the developing agent is accumulated. The magnitude of the magnetic flux density of the magnet is at least one half or more of the magnitude of the magnetic flux density of the cutting pole, and is preferably equal to or more than the magnitude of the magnetic flux density of the cutting pole. However, if the magnitude of the magnetic flux density of the magnet is three times or more of the magnitude of the magnetic flux density of the cutting pole, problems are caused by the excessive attraction force of the magnet.

A method for measuring the above-described force (magnetic force) F applied to the magnetic carrier, which includes magnetic bodies, will be described below.

The above discussions are based on a two-dimensional plane defined by the normal direction and the circumferential (tangential) direction of the developing sleeve. This is because the component of the magnetic flux density B in the longitudinal direction is substantially zero in areas other than the ends of the developing sleeve and there is no problem in discussing the magnetic flux density B on a two-dimensional plane. The reason why the component of the magnetic flux density B in the longitudinal direction is substantially zero can be understood from the following explanation. That is, when, for example, it is assumed that the magnet roller is composed of short magnet rollers having a unit length that are connected to each other and the repeating boundary conditions are applied, it is not possible that magnetic lines of force extend between the short magnet rollers that are identical to each other. Therefore, the following discussion is also based on the two-dimensional plane defined by the normal direction and the circumferential (tangential) direction of the developing sleeve.

The magnetic force F can be expressed using the external magnetic field (magnetic flux density) B as follows:

$$F=(m\cdot\nabla)B$$

where F=(Fr, Fθ).

The magnitude of the magnetic force can be expressed as $|F|=(Fr^2+F\theta^2)^{1/2}$ In the above equation, the magnetic dipole moment m of the magnetic carrier generally has a magnetization that is proportional to the external magnetic field. Therefore, the magnetic dipole moment m can be expressed as follows:

$$m = |A|B$$

$$F = |A|(B\cdot\nabla)B$$

$$= -|A|\nabla B^2$$

$$Fr(r,\theta) = -|A|\{B^2(r,\theta) - B^2(r+\Delta r,\theta)\}/\Delta r$$

$$F\theta(r,\theta) = -|A|\{B^2(r,\theta) - B^2(r,\theta+\Delta\theta)\}/r\Delta\theta$$

where |A| is a function including a magnetic permeability.

When particles of the carrier are spherical, |A| can be expressed as follows:

$$|A|=(4\pi/\mu_0)\times(\mu-1)/(\mu-2)\times r^3$$

where r is a radius of the particles, μ is a relative magnetic permeability of the carrier, and $\mu_0$ is the magnetic permeability of vacuum.

It is clear from the above description that when the magnitude of the magnetic field $|B|(=\{Br^2+B\theta^2\}^{1/2})$ is varied, the magnetic force is generated in the direction from the position where the magnetic flux density is small toward the position where the magnetic flux density is large. The magnetic force is not generated along the direction in which the magnitude of the magnetic field |B| is not varied. Therefore, when the magnitude of the magnetic field (magnetic flux density) is continuously measured in the area where the magnetic force is to be determined, the magnitude and direction of the magnetic force F can be determined by the equations given above on the basis of the difference in the magnitude of the magnetic field (magnetic flux density).

The magnitude of the external magnetic field (magnetic flux density) |B| can be measured by a commercially available Gauss (Tesla) meter. The inventors of the present invention used a Gauss meter Model 640 produced by Bell Corporation. A magnetic flux density in a certain direction at an end of a probe can be measured by the Gauss meter. Therefore, magnetic flux densities in two directions (Br and Bθ)) were measured using two types of probes for the r-axis and θ-axis, and the magnitude of the magnetic field was determined from the measurement result. The measurement of the magnetic flux densities was repeated to determine the distribution of the magnitude of the magnetic field, and the magnitude and direction of the magnetic force F were determined on the basis of the result of the determination.

The precision of measurement of the distribution of the magnetic field can be increased as Δr and Δθ are reduced. However, in such a case, the measurement time will be increased. Therefore, Δr and rΔθ were set to about 5 mm, and values at intermediate points were approximated by interpolation. The probes were fixed to an xyz stage, and the measurement was continuously performed while moving the probes.

The magnetic force applied to the carrier can be determined from the results of the above-described measurement using the above equations.

For example, assuming that particles of the carrier have a spherical shape with a radius of 17.5 μm, a relative magnetic permeability μ of the carrier is 12, and a true specific gravity ρ of the carrier is of 4.8 g/cm$^3$, since the magnetic permeability of vacuum is $4\pi\times10^{-7}$, |A| is calculated as $|A|=2.46\times10^{-6}$ m$^3$. Therefore, the magnetic force can be determined from the square $B^2$ of the magnitude of the magnetic field.

$$Fr = |A|\Delta Br^2/\Delta r$$

$$= (2.5\times10^{-6})/(2.5\times10^{4})\times\Delta Br^2$$

$$= 10^{-2}\times\Delta Br^2(N)$$

$$= 10^{-2}\times(B_r^2 - B_{r+\Delta r}^2)(N)$$

Since the magnetic force corresponds to the difference between the squares of the magnitudes of magnetic fields, the magnetic force increases as the magnitude of the magnetic force increases and as a difference in the magnitude of the magnetic force increases. Even when the difference in the magnitude of the magnetic field is relatively large, the magnetic force is small if the magnitude of the magnetic field is small. This coincides with the actual result.

The magnetic force can be determined by the above-described method. Here, the position at which the direction of the magnetic force is switched to the direction toward the magnet is to be determined, in particular, in the area between the magnetic pole in the magnet roller and the magnet. Therefore, the measurement can be performed mainly in this area.

For example, first, the inventors of the present invention measured Br and Bθ in the area between the magnet roller and the magnet in a direction from the magnet roller toward the magnet with intervals of 5 mm. The square $|B|^2$ of the magnitude of the magnetic flux density B was determined for each point. Although the value of $|B|^2$ decreased as the distance from the magnet roller increased, the value of $|B|^2$ started to increase again at a certain point. The area around this point was more precisely measured, and the point at which the value of $|B|^2$ started to increase was more accurately determined.

Then, it was determined that the area closer to the magnet than this point is the area in which the magnetic force is directed toward the magnet.

FIGS. 10 to 12 are based on the results obtained by the above-described measurement.

The area in which the magnetic force is directed toward the magnet can be determined by the above-described measurement. Then, the magnetic force and the arrangement of the magnet are adjusted such that the area in which the developing agent is present does not overlap the area in which the magnetic force is directed toward the magnet. Accordingly, the problems to be solved by the present invention can be solved.

Although it may seem that it requires a large amount of trial and error to adjust the position and size of the magnet, the position at which the direction of the magnetic force applied to the developing agent changes to the direction toward the magnet can be predicted as described below. Therefore, the adjustment does not require a large amount of trial and error.

Figure 13:
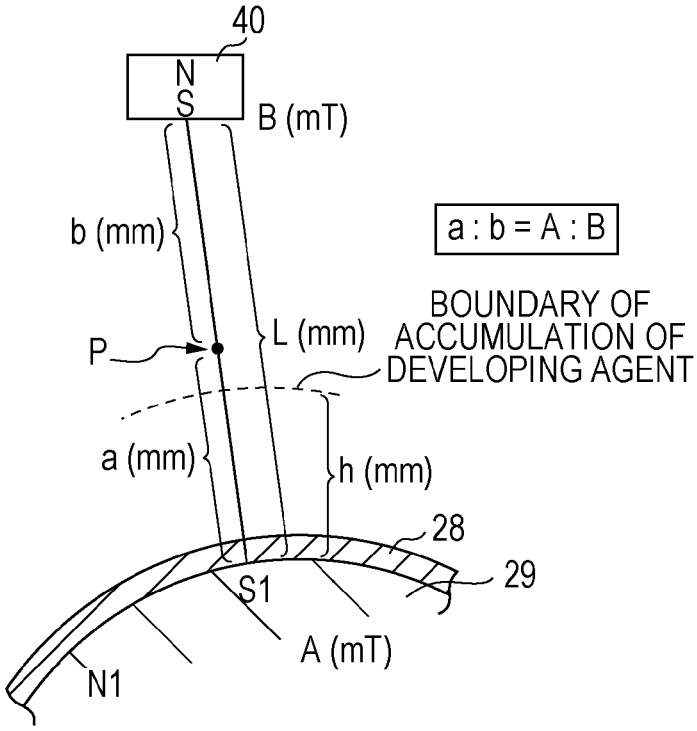
FIG. 13 is a diagram illustrating the point at which the direction of the magnetic force changes.

In the case where the magnetic force of the magnet is equal to that of the cutting pole of the magnet roller, the position at which the direction of the magnetic force applied to the developing agent changes to the direction toward the magnet is at a substantially central position between the magnet and the cutting pole. When the magnetic force of the magnet is increased, the position at which the direction of the magnetic force changes to the direction toward the magnet is shifted toward the magnet roller. When the magnetic force of the cutting pole of the magnet roller is increased, the position at which the direction of the magnetic force changes to the direction toward the magnet is shifted toward the magnet. This is because the distance between the magnet and the position at which the direction of the magnetic force changes and the distance between the cutting pole of the magnet roller and the position at which the direction of the magnetic force changes are determined by the ratio between the magnitudes of the magnetic flux densities of the magnet and the cutting pole. This will be described with reference to FIG. 13. The distance between the position of the cutting pole of the magnet roller and the magnet is L (mm). The distance L is equal to the length of a line that connects a peak position that corresponds to a peak magnetic flux density on the surface of the magnet that faces the cutting pole and the cutting pole. The magnitude of the magnetic flux density of the cutting pole of the magnet roller is A (mT), and the magnitude of the magnetic flux density of the magnet at the peak position is B (mT). In this case, the position at which the direction of the magnetic force changes from the direction toward the magnet roller to the direction toward the magnet is located around a point P that divides the line that connects the position of the cutting pole of the magnet roller and the magnet at the ratio of A:B. Therefore, the problems to be solved by the present invention can be solved when the point P is outside the area in which the developing agent accumulates.

When a (mm) is a distance between the cutting pole of the magnet roller and the position at which the direction of the magnetic force changes to the direction toward the magnet and b (mm) is a distance between the magnet and the position at which the direction of the magnetic force changes to the direction toward the magnet roller, a and b can be expressed as a=(A/(A+B))×L and b=(B/(A+B))×L, respectively. When h (mm) is the distance between the magnet roller and the area in which the developing agent accumulates behind the regulating blade, h<a may be satisfied. In such a case, the point P at which the direction of the magnetic force changes from the direction toward the magnet roller to the direction toward the magnet is outside the area in which the developing agent accumulates. Therefore, the problems to be solved by the present invention can be solved by adjusting the magnetic force B of the magnet and the position L of the magnet so as to satisfy the following expression:

$$h<(A/(A+B))\times L$$

Table 1 shows the parameters of the above-described example and comparative examples. As is clear from this table, when the adjustment is made so that h is smaller than (A/(A+B))×L, developing-agent amount variation is satisfactory (O). In contrast, when h is larger than (A/(A+B))×L, developing-agent amount variation occurs (X).

TABLE 1

| | h (mm) | L (mm) | A (mT) | B (mT) | (A/(A + B)) × L | Developing-Agent Amount Variation |
|---|---|---|---|---|---|---|
| Example 1 | 20 | 45 | 50 | 50 | 22.5 | ○ |
| Comparative Example 1 | 20 | 30 | 50 | 50 | 22.5 | X |
| Comparative Example 2 | 20 | 45 | 50 | 100 | 22.5 | X |

The distance L (mm) between the position of the cutting pole of the magnet roller and the magnet will now be described. According to the present invention, in a sectional view (FIG. 13) of the developing apparatus 4 taken along a plane perpendicular to the axial direction of the developing sleeve 28, a position corresponding to a peak of the normal component Br of the magnetic flux density of the cutting pole S1 of the magnet roller 29 is defined as one end of a line. In addition, the center of the surface of the magnet 40 having the same polarity as that of the cutting pole S1 (peak position that corresponds to a peak of the magnetic flux density on the surface of the magnet 40 having the same polarity as that of the cutting pole S1) is defined as the other end of the line. The length of this line is defined as the distance L (mm) between the position of the cutting pole of the magnet roller and the magnet.

The distance h (mm) between the area where the developing agent is accumulated in the section behind the regulating blade and the magnet roller is defined as the dimension of the area in which developing agent is accumulated along the above-described line.

There is a possibility that the amount of accumulation of the developing agent will somewhat vary depending on the environment in which the product is placed or the manner in which the product is used. However, in the structure in which the amount of developing agent in the section behind the regulating blade is ensured by the magnetic force of the cutting pole, the amount of accumulation of the developing agent does not largely vary. Therefore, problems hardly occur when h (mm) measured under the standard specification, which will be described below, satisfies the above-described conditional expression. The dimension h of the area in which the developing agent accumulates can be adjusted as follows. That is, the dimension h of the area in which the developing agent accumulates is determined by the amount of toner that flows into this area and the amount of toner that flows out from this area. The amount of toner that flows out is determined by the gap between the blade and the sleeve and the rotational speed of the developing sleeve. The amount of toner that flows in can be adjusted by adjusting the amount of toner that is carried up to the developing sleeve. The amount of toner that is carried up to the developing sleeve can be increased by increasing the peak magnetic force of the toner carrying pole (N1 in FIG. 7). The amount of toner that is carried up to the developing sleeve can be adjusted by adjusting the half-width of the toner carrying pole. The toner carrying pole is the pole that is on the downstream side of a repulsive pole in the rotation direction of the sleeve. In the present embodiment, the dimension h of the area where the developing agent accumulates is adjusted by adjusting the peak magnetic force of the toner carrying pole.

In the present invention, h (mm) is defined as the dimension of the area where the developing agent accumulates in the case where a standard image in which an image ratio is 10% for each color is formed on ten thousand sheets of A4 size paper in a low-humidity environment (humidity 5%, temperature 23° C.) where the amount of charge of the developing agent is large and the volume of the developing agent tends to increase.

As described above, even when the dimension of the area where the developing agent accumulates temporarily varies in the process of forming the image on ten thousand sheets of paper, the effects of the present invention can be obtained if $h<(A/(A+B))\times L$ is satisfied after the process of forming the image on thousand sheets of paper.

The arrangement of the magnet will be further described. As illustrated in FIG. 4, in the present embodiment, the magnet 40 is disposed outside the developing-agent container 22. The reason for this is to prevent the developing agent from coming into direct contact with the magnet. If the developing agent comes into direct contact with the magnet, it is difficult to remove the developing agent from the magnet. Therefore, the magnet is disposed at a position where the developing agent does not come into direct contact therewith.

With regard to the structure of the regulating blade, although the regulating blade formed of a non-magnetic plate is mainly described above, the above discussion can be applied to regulating blades having other structures. Also in such cases, the above-described effects can be obtained. However, in the case where the regulating blade is formed of a combination of a non-magnetic plate and a magnetic plate or is formed only of a magnetic plate, an attraction force is generated in a direction toward the magnetic plate. Therefore, the developing-agent stationary layer is easily formed in the area where the attraction force is applied. In contrast, the regulating blade formed only of the non-magnetic plate as described in the present embodiment is advantageous in that the above-mentioned risk can be eliminated.

Figure 14:
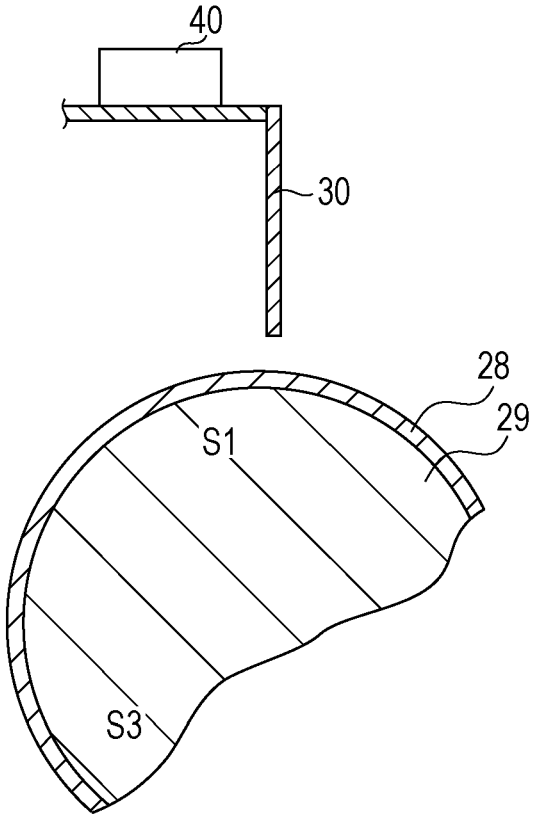
FIG. 14 is a diagram illustrating a developing apparatus according to a modification of the first embodiment.

In addition, in the present embodiment, a pole N1 having a polarity opposite to that of S1 is positioned next to S1 in the section upstream of the regulating blade in the conveying direction of the developing agent. However, as illustrated in FIG. 14, a pole S3 having the same polarity as that of S1 may be positioned next to S1 at the upstream side thereof. In this structure, the repulsive magnetic field is generated between the poles S1 and S3. Therefore, the magnetic force is reduced in the area between S1 and S3. However, the magnetic force applied in the area around the cutting pole S1 is substantially the same as that in the structure of the present embodiment in which the pole N1 having the polarity opposite to that of the cutting pole S1 is positioned next to the cutting pole S1 at the upstream side thereof. Therefore, the behavior of the developing agent is substantially the same as that in the present embodiment in the area near the regulating blade. As a result, the effects of the present invention described in the present embodiment can also be obtained in the structure in which the pole S3 having the same polarity as that of the cutting pole S1 is positioned next to the cutting pole S1 at the upstream side thereof.

The magnet used in the present embodiment is not particularly limited as long as the magnet generates the magnetic field from itself. For example, magnets obtained by magnetizing alloy magnetic powder made of various metal elements, such as iron, and rare-earth elements may be used. When the magnet has an S-pole at one side and an N-pole at the other side, the repulsive magnetic field can be easily formed over the entire area of the magnet roller in the axial direction. Therefore, the magnet having such a structure is used in the present embodiment.

Lastly, the developing agent used in the present invention will be described. In the present embodiment, the developing agent including non-magnetic toner and magnetic carrier is mainly described. However, the developing agent is not limited to this. Even when other types of developing agent, such as developing agent including only magnetic toner, are used, effects similar to the above-described effects can be obtained as long as the developing agent includes magnetic bodies.

The angle of rest $\phi$ of the developing agent affects the structure of the present invention in view of the frictional coefficient between particles of the developing agent. The angle of rest is included in the above-mentioned equation for determining the frictional force as the internal friction angle $\phi$. According to the examinations made by the inventors of the present invention, it is necessary that the angle of rest $\phi$ be in the range of 20° to 70°. The angle of rest $\phi$ is preferably in the range of 30° to 60°, and more preferably, in the range of 35° to 50°.

When the value of the angle of rest $\phi$ is increased, $\tan\phi$ is also increased. Therefore, the frictional force $\mu\sigma$ calculated as $\mu\sigma=(W+fr)\tan\phi$ is also increased accordingly. In such a case, even when the magnet is provided, the effects of the magnet cannot be easily exerted. When the value of the angle of rest is reduced, the fluidity of the developing agent is excessively increased. As a result, problems such as degradation of performance of the developing agent, scattering of the developing agent, or leakage of the developing agent will occur, which may be more serious than the problems to be solved by the present invention.

Figure 15:
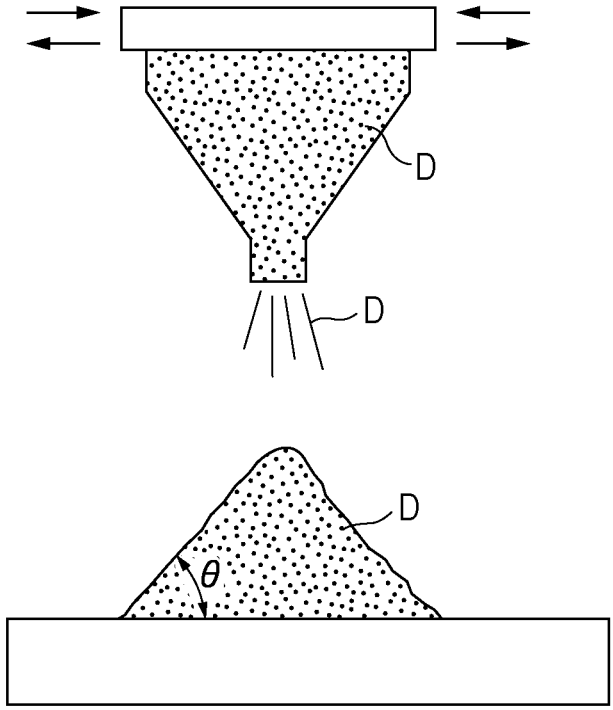
FIG. 15 is a diagram illustrating a method for measuring an angle of rest.

Referring to FIG. 15, the angle of rest of the developing agent is an angle of a slope formed in a lower section when the developing agent D is sifted from an upper section, that is, the angle $\phi$ shown in the figure. The developing agent D cannot slide down a slope by itself when an angle of the slope is less than or equal to $\phi$.

The angle of rest can be measured by, for example, the following method.

That is, a powder tester (Model PT-N produced by Hosokawa Micron Corporation) is used. A 246-μm screen is set to a vibrating table, and 250 cc of the sample is placed on the screen. Then, the vibrating table is vibrated for 180 seconds, and the angle of rest of the toner on an angle-of-rest measurement table is measured by an angle measuring arm.

In the present embodiment, the repulsive magnetic field is formed by placing the magnet outside the developing sleeve. However, the present invention is not limited to this. For example, an electromagnet that includes a coil and that generates a magnetic field when a current is applied to the coil may instead be used. In such a case, the dimension h of the area where the developing agent accumulates may be defined as a dimension along the line that connects the winding center of the coil at an of the coil that faces the cutting pole and the cutting pole.

Second Embodiment

The difference between the second embodiment and the first embodiment will be described below. Other structures of the second embodiment are similar to those of the first embodiment. Therefore, components of the second embodiment corresponding to those of the first embodiment are denoted by the same reference numerals, and explanations thereof are thus omitted.

In the first embodiment, the magnet is arranged such that the area where the magnetic force is applied to the developing agent in the direction toward the magnet is not included in the area where the developing agent accumulates. In this structure, since the magnetic force is not applied in the direction toward the magnet in the area where the developing agent accumulates, the developing agent is prevented from accumulating around the magnet in a short time. However, in the case where the product is used for a long time, there is a possibility that the developing agent will gradually accumulate around the magnet. Even when the developing agent accumulates around the magnet, the developing agent does not immediately affect the operation. However, the amount of developing agent that can be used decreases. In addition, there is a possibility that the developing agent that has been attracted to and accumulated around the magnet will fall from the magnet owing to vibration or the like. In such a case, the amount of charge and the like of the developing agent that has fallen from the magnet differ from those of the developing agent in the surrounding areas. Therefore, there is a risk that defects such as non-uniform density will occur in the resulting images.

Accordingly, in the present embodiment, the area in which the magnetic force is applied to the developing agent in the direction toward the magnet is filled with an agent-blocking member.

Figure 16:
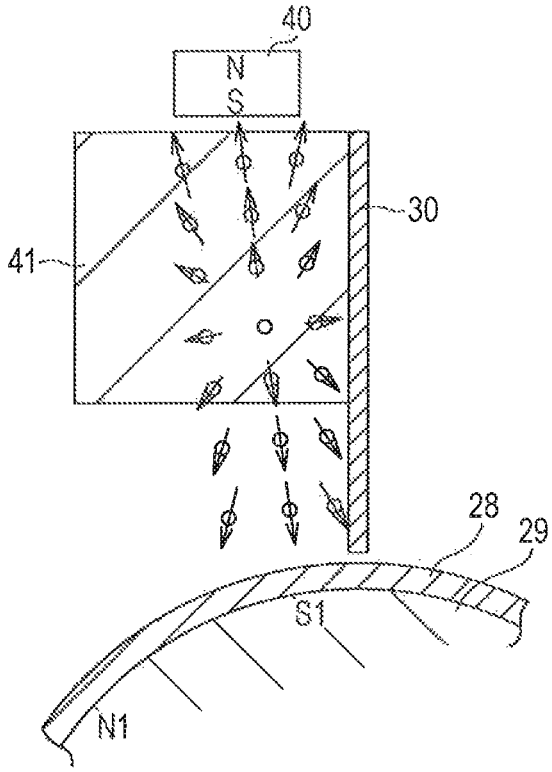
FIG. 16 is a diagram illustrating a movement of a boundary surface according to a second embodiment of the present invention.

FIG. 16 is a schematic sectional view illustrating the state of the two-component developing agent in the section upstream of the regulating blade according to the present embodiment. The magnetic forces of the magnet roller 29 and the magnet 40 and the arrangement of the magnet 40 are similar to those in the first embodiment illustrated in FIG. 10. The present embodiment is characterized in that an agent-blocking member 41, which is a characteristic part of the present embodiment, is additionally provided. The agent-blocking member 41 is arranged so as to fill the area in which the magnetic force is applied in the direction toward the magnet 40. Therefore, this structure is more advantageous than that of the first embodiment in that the developing agent is prevented from being attracted to the magnet 40, and the above-described risk can be eliminated. However, since the number of components is increased, costs are increased accordingly. Therefore, the agent-blocking member may be provided as necessary in accordance with the allowable product cost, life of the product, and other specifications.

The above-described effects can be obtained even when the agent-blocking member is hollow. With regard to the material, the agent-blocking member is preferably made of a non-magnetic material. If the agent-blocking member is made of a magnetic material, the agent-blocking member is magnetized in the magnetic field. As a result, the developing agent adheres to the agent-blocking member. In the present embodiment, ABS resin is used as a material of both the developing-agent container and the agent-blocking member.

According to the present invention, a developing apparatus can be provided which is capable of suppressing the generation of the developing-agent stationary layer and stably maintaining the layer thickness of the developing agent conveyed to the developing area for a long time by weakening a magnetic field component in the normal direction with respect to the developing-agent bearing member in the section immediately upstream of the regulating blade.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

The invention claimed is:

1. A developing apparatus that develops a latent image formed on an image bearing member, the developing apparatus comprising:

a rotatable developing-agent bearing member that bears developing agent including magnetic particles;

a magnet disposed in the developing-agent bearing member and restraining the developing agent on a surface of the developing-agent bearing member;

a regulating member that is spaced from the developing-agent bearing member by a predetermined distance, the regulating member regulating an amount of the developing agent on the surface of the developing-agent bearing member; and magnetic-field generating means disposed outside the developing-agent bearing member so as to face the developing-agent bearing member, the magnetic-field generating means generating a magnetic field in a direction such that the magnetic field cancels at least a normal component of a magnetic field generated from a surface of the magnet that faces an area of the developing-agent bearing member that is immediately upstream of the regulating member in a rotation direction of the developing-agent bearing member, the normal component being a component of the magnetic field in a normal direction of the developing-agent bearing member, wherein the magnet includes a plurality of magnetic poles at the surface of the magnet, and the magnetic-field generating means is arranged such that the following expression is satisfied:

$$h<(A/(A+B))\times L$$

where A (mT) is a magnitude of a magnetic flux density of a nearest magnetic pole, which is one of the plurality of magnetic poles that is nearest to the regulating member, B (mT) is a magnitude of a magnetic flux density at a peak position that corresponds to a peak magnetic flux density on a surface of the magnetic-field generating means that faces the nearest magnetic pole, L (mm) is a distance between the nearest magnetic pole and the peak position, and h (mm) is a distance from the nearest magnetic pole to an area where the developing agent is not present along a line that connects the nearest magnetic pole and the peak position.

2. The developing apparatus according to claim 1, wherein the nearest magnetic pole is positioned upstream of the regulating member in the rotation direction of the developing-agent bearing member, wherein the magnetic-field generating means faces the nearest magnetic pole, and wherein the surface that faces the nearest magnetic pole generates a magnetic field with the same polarity as a polarity of the nearest magnetic pole.

3. The developing apparatus according to claim 1, further comprising a non-magnetic agent-blocking member that is positioned so as to face the area of the developing-agent bearing member that is immediately upstream of the regulating member, the agent-blocking member regulating an amount of the developing agent so as to prevent the developing agent from being conveyed to an area where a normal component of a magnetic force applied to the magnetic particles is directed toward the outside of the developing-agent bearing member, the normal component being a component of the magnetic force in the normal direction of the developing-agent bearing member.

4. The developing apparatus according to claim 2, further comprising a non-magnetic agent-blocking member that is positioned so as to face the area of the developing-agent bearing member that is immediately upstream of the regulating member, the agent-blocking member regulating an amount of the developing agent so as to prevent the developing agent from being conveyed to an area where a normal component of a magnetic force applied to the magnetic particles is directed toward the outside of the developing-agent bearing member, the normal component being a component of the magnetic force in the normal direction of the developing-agent bearing member.

* * * * *